US007670034B2

(12) United States Patent
Zhang et al.

(10) Patent No.: US 7,670,034 B2
(45) Date of Patent: Mar. 2, 2010

(54) LED LAMP

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 94 days.

(21) Appl. No.: 12/036,300

(22) Filed: Feb. 25, 2008

(65) Prior Publication Data

US 2009/0147521 A1 Jun. 11, 2009

(30) Foreign Application Priority Data

Dec. 7, 2007 (CN) ..... 2007 1 0124921

(51) Int. Cl.
*F21V 21/00* (2006.01)

(52) U.S. Cl. ..... 362/373; 362/294; 362/341; 362/298

(58) Field of Classification Search ..... 362/294, 362/373, 241, 296.1, 298
See application file for complete search history.

(56) References Cited

U.S. PATENT DOCUMENTS 6,183,100 B1 * 2/2001 Suckow et al. ..... 362/35
6,613,288 B2 * 9/2003 Gupte ..... 422/125
6,854,208 B1 * 2/2005 Chuang et al. ..... 43/125
6,871,983 B2 * 3/2005 Jacob et al. ..... 362/364
7,093,952 B2 * 8/2006 Ono et al. ..... 362/194
7,160,010 B1 * 1/2007 Chinniah et al. ..... 362/511
7,178,937 B2 * 2/2007 McDermott ..... 362/187
2003/0231488 A1 * 12/2003 Albee ..... 362/96
2004/0264185 A1 * 12/2004 Grotsch et al. ..... 362/231

FOREIGN PATENT DOCUMENTS

CN 2699114 Y 5/2005

* cited by examiner

*Primary Examiner*—Ali Alavi
(74) *Attorney, Agent, or Firm*—Frank R. Niranjan

(57) ABSTRACT

An LED lamp includes a housing having a base, a frame at a top end of the housing and a plurality of stanchions interconnecting the base and the frame. A heat sink is mounted on the frame. An LED module is received in the housing and attached on a bottom surface of the heat sink. A printed circuit board is arranged on the base of the housing, and a reflector is located on the printed circuit board. A transparent envelope is received in the housing and covers windows defined between the stanchions. A light generated by the LED module is reflected by the reflector to transmit outwardly through the envelope to illuminate a surrounding environment.

20 Claims, 3 Drawing Sheets

LED LAMP

BACKGROUND OF THE INVENTION

1. Field of the Invention

The present invention relates to an LED lamp for a lighting purpose, and more particularly to an improved LED lamp having a novel structure for use in the outdoors.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient. The large number of LEDs leads to a more expensive module and one with greater power consumption. The greater power usage leads to greater heat output, which, if not adequately addressed at additional expense, impacts the LED lamp reliability. Therefore, various heat dissipation devices with complicated structures are exploited in the LED lamp, which increasing the difficulty and cost of the manufacturing of the LED lamp.

Besides, since a lighting angle of the LEDs is generally restricted in a narrow range, light of the LED lamp is of unsatisfactory spatial distribution, whereby a more larger illumination area can not be provided.

What is needed, therefore, is an improved LED lamp which has a simple and novel structure, whereby the LED lamp is suitable to mass-manufacture and has a satisfactory illumination area.

SUMMARY OF THE INVENTION

An LED lamp includes a housing, a heat sink, an LED module, a printed circuit board and a reflector. The housing has a base and a frame formed on a top end of the housing. The heat sink is located on the frame. The LED module is received in the housing and attached on a bottom surface of the heat sink. The printed circuit board is arranged on the base of the housing. The reflector is located on the printed circuit board to reflect light generated by the LED module towards an outside of the housing. The reflector has a cone-shaped configuration with a tip pointing toward the LED module.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
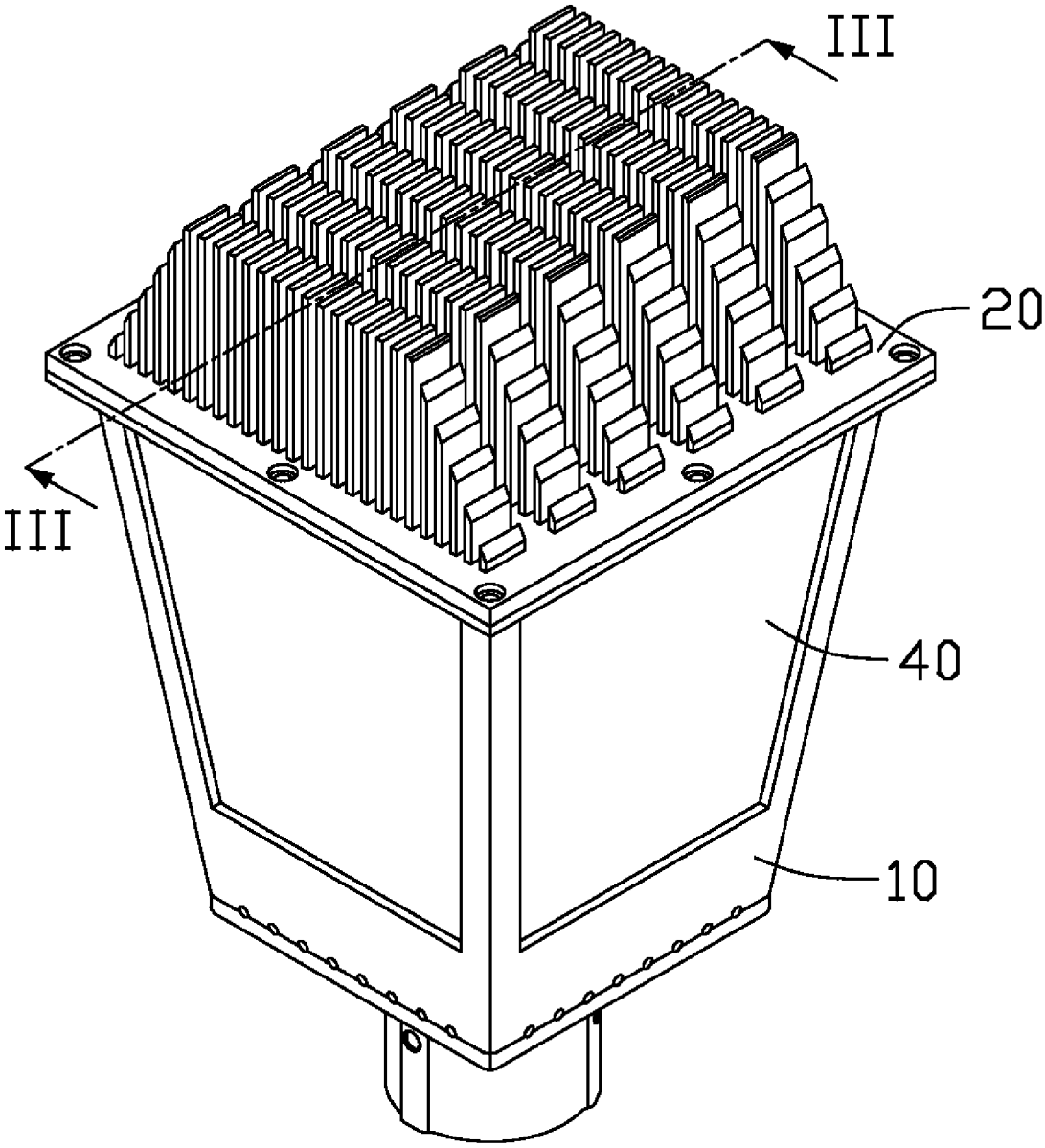
FIG. 1 is an isometric, assembled view of an LED lamp in accordance with a preferred embodiment of the present invention.
Figure 2:
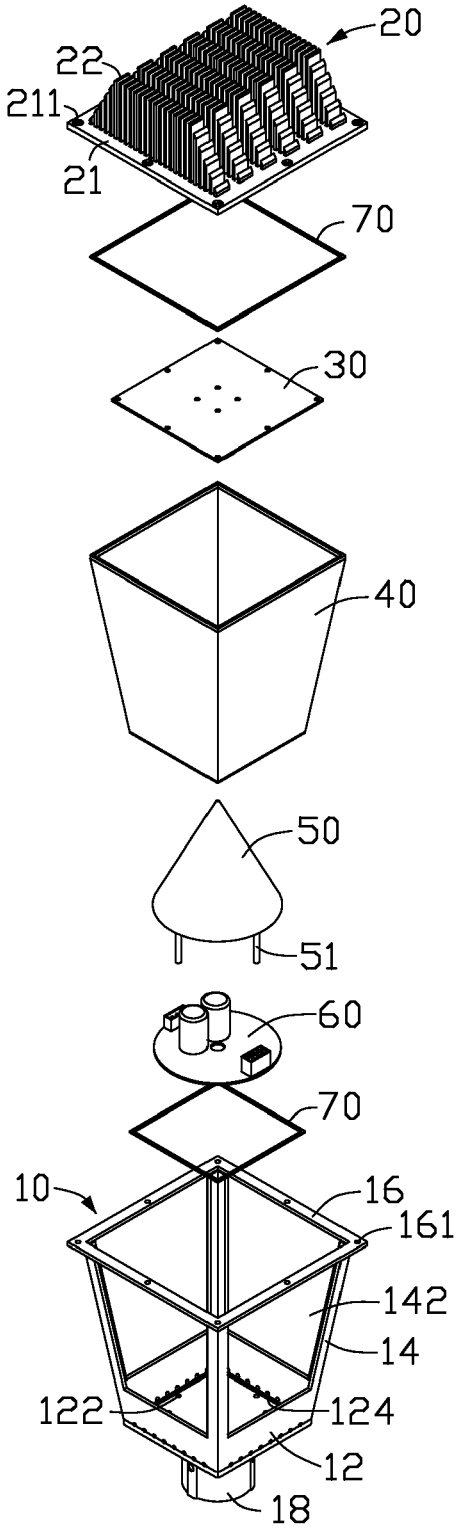
FIG. 2 is an exploded view of FIG. 1.
Figure 3:
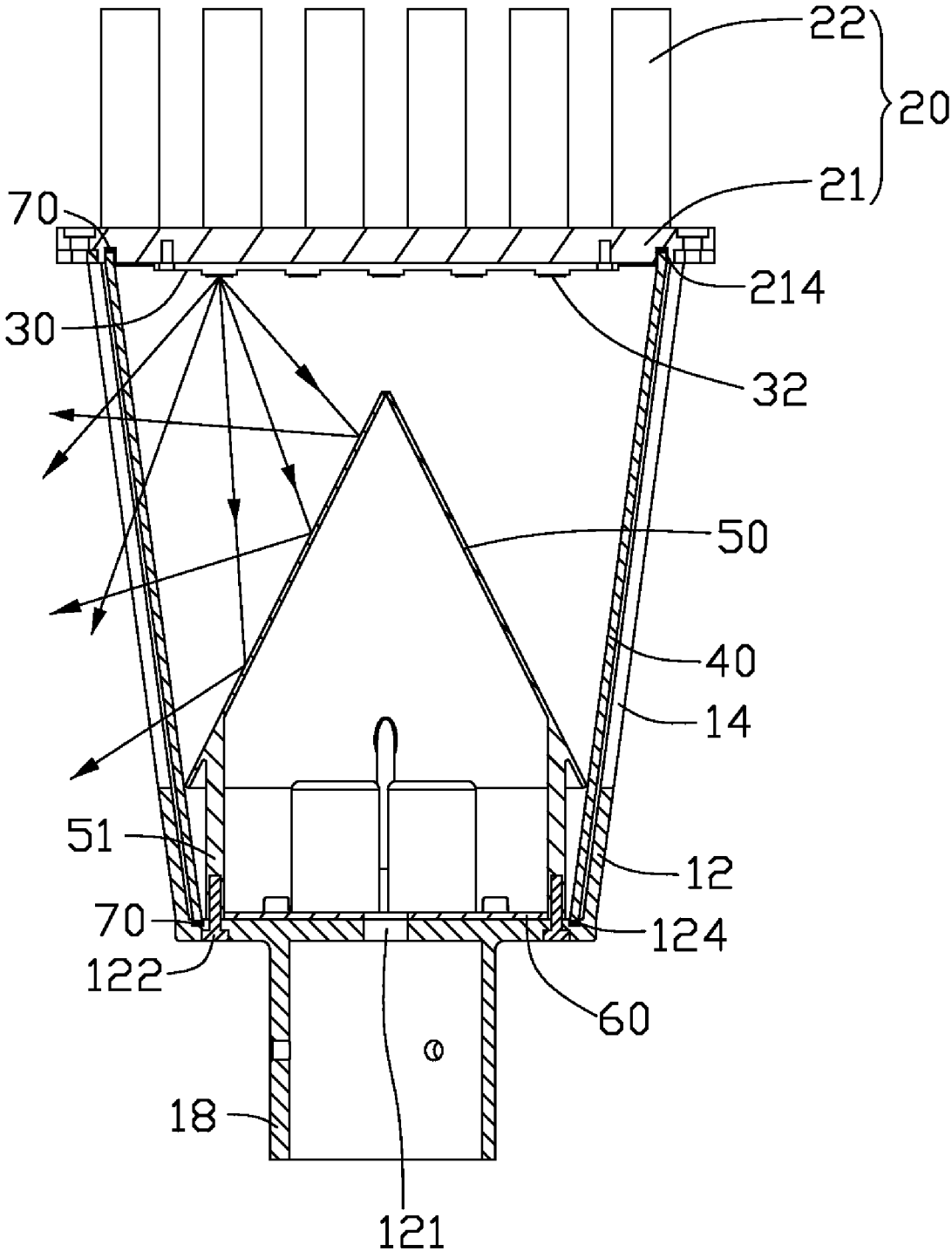
FIG. 3 is a cross-section view of FIG. 1, taken along line III-III thereof.

Referring to FIGS. 1-3, an LED lamp in accordance with a preferred embodiment is illustrated. The LED lamp comprises a housing 10, a heat sink 20 disposed on the housing 10, an LED module 30 attached on a bottom surface of the heat sink 20, a reflector 50 and a printed circuit board 60 accommodated in the housing 10. An envelope 40 is fitly received in the housing 10. Light emitted by the LED module 30 is reflected by the reflector 50 to travel through the envelope 40 to illuminate a surrounding environment.

The housing 10 comprises a base 12, a top frame 16 and four stanchions 14 interconnecting the base 12 and the top frame 16. The base 12 is substantially rectangular. A through hole 121 is defined in a center of the base 12 and four fixing holes 122 are defined in the base 12 and adjacent to four side edges of the base 12. Four stanchions 14 extend upwardly and outwardly from four corners of the base 12. The top frame 16 has a rectangular shape and connects ends of the four stanchions 14 with four corners thereof. An area of the top frame 16 is larger than that of the base 12. A plurality of first securing holes 161 is defined in the top frame 16. The base 12, the stanchions 14 and the top frame 16 corporately define a space (not labeled) for receiving the printed circuit board 60, the reflector 50, the envelope 40 and the LED module 30 therein. A window 142 is defined between every two adjacent stanchions 14, through which the light emitted by the LED module 30 can project outside of the housing 10. A connecting portion 18 extends downwardly from the base 12 for securing the LED lamp onto a supporting structure (not shown) such as a supporting post.

The heat sink 20 is mounted on the top frame 16 of the housing 10 and comprises a bottom plate 21 and a plurality of fins 22 arranged on the bottom plate 21. Corresponding to the first securing holes 161 in the top frame 16, a plurality of second securing holes 211 is defined in the bottom plate 21 for fixtures (not shown) to extend therethrough to engage in the first securing holes 161 thereby fixing the heat sink 20 to the housing 10.

The LED module 30 is attached to a bottom surface of the bottom plate 21 of the heat sink 20 and comprises a plurality of LEDs 32 arrayed thereon in a matrix. The LED module 30 defines a plurality of screw holes (not labeled) therein for fixtures (not shown) to extend therethrough to engage in the bottom surface of the bottom plate 21, thereby assembling the LED module 30 to the bottom surface of the bottom plate 21.

The printed circuit board 60 is placed on the base 12. The printed circuit board 60 is electrically connected to the LED module 30 via wires (not shown) for providing the LED module 30 with power, control signals, etc. The printed circuit board 60 can further get power from a power supply (not shown) via wires (not shown) through the through hole 121 in the base 12.

The reflector 50 is located on and covering the printed circuit board 60. In the present embodiment, the reflector 50 has a conical configuration, with a tip end thereof facing towards the LED module 30 and a bottom end thereof facing towards the printed circuit board 60. Four legs 51 extend downwardly from an inner surface of a bottom portion of the reflector 50. The four legs 51 are inserted into the fixing holes 122 and engage with the base 12 via fixtures (not labeled). Light generated by the LED module 30 is reflected towards an outside of the housing 10 by an outer surface of the reflector 50. Understandably, the configuration of the reflector 50 can be various. For instance, the reflector 50 can be a polyhedron with lateral surfaces slantwise to the LED module 30 for reflecting light towards the envelope 40 omnidirectionally.

The envelope 40 has a substantially similar configuration with the housing 10 and is fitly received in the housing 10, serving for protecting components received in the housing 10 such as the reflector 50, the printed circuit board 60, etc. The envelope 40 has four sidewalls, with each of the sidewalls extending over a corresponding one of the windows 142 of the housing 10. Each of four corners of the envelope 40 connects every two adjacent sidewalls of the envelope 40 and fittingly abuts against one of the stanchions 14. A bottom end of the envelope 40 abuts against the base 12 of the housing 10, and a top end of the envelope 40 abuts against the bottom surface of the bottom plate 21 of the heat sink 20. Specifically, receiving grooves 124, 214 are respectively defined in the base 12 and the bottom surface of the bottom plate 21 for respectively receiving the bottom end and the top end of the envelope 40 therein. Furthermore, a waterproof cushion 70 can be received in each of the grooves 124, 214 and sandwiched between the base 12 and the bottom end of the envelope 40 and the bottom plate 21 of the heat sink 20 and the top end of the envelope 40. The waterproof cushion 70 can prevent rainwater from creeping into the housing 10 when the LED lamp is used in the outdoors.

The envelope 40 should be made of a transparent or semitransparent material such as glass, plastic, etc., for allowing the light emitted by the LED module 30 project therethrough to illuminate a surrounding environment. When the envelope 40 is made of a semitransparent material, the LED lamp in accordance with the present invention can generate a more soft and uniform light.

In assembly, the printed circuit board 60 is placed on the base 12 of the housing 10. The reflector 50 is located on the printed circuit board 60 and engaged with the base 12 of the housing 10. The envelope 40 is received in the housing 10. The heat sink 20 assembled with the LED module 30 then is coupled onto the top frame 16 of the housing 10.

In operation, referring to FIG. 3, the LED module 30 gets power from the printed circuit board 60 and generates light. Shown as arrows in the FIG. 3, a part of the light can directly project towards the outside of the housing 10, and another part of the light projects to the reflector 50. When reaching the outer surface of the reflector 50, the light can be reflected out of the housing 10. Since the outer surface of the reflector 50 is slantwise to the LED module 30, the light emitted from the planar LED module 30 can be reflected in a multidirectional manner, which increases the illumination area of the LED lamp. The heat sink 20 can absorb heat generated by the LED module 30 and dissipate the heat into ambient air when the LED lamp is operated. Besides, the heat sink 20 located on the housing 10 can serve as a protective component for preventing rainwater, dust, etc. from entering into the LED lamp.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:
a housing comprising a base and a top frame formed above the base;
a heat sink disposed on the top frame;
an LED module accommodated in the housing and attached to a bottom surface of the heat sink;
a printed circuit board mounted on the base of the housing; and
a reflector located on the printed circuit board to reflect light generated by the LED module towards an outside of the housing.

2. The LED lamp as claimed in claim 1, wherein the reflector is conical, with a tip end thereof facing towards the LED module.

3. The LED lamp as claimed in claim 1, wherein the reflector is a polyhedron and has a bottom end thereof facing towards the printed circuit board.

4. The LED lamp as claimed in claim 1, wherein the housing further comprises a plurality of stanchions interconnecting the base and the top frame, with a window defined between every two adjacent stanchions.

5. The LED lamp as claimed in claim 4, wherein the stanchions extend upwardly and outwardly from corners of the base.

6. The LED lamp as claimed in claim 4, wherein an envelope is fitly received in the housing for shielding the windows.

7. The LED lamp as claimed in claim 6, wherein the envelope is made of a transparent or semitransparent material.

8. The LED lamp as claimed in claim 6, wherein a waterproof cushion is sandwiched between the base and the envelope, and a waterproof cushion is sandwiched between the envelope and the heat sink.

9. The LED lamp as claimed in claim 1, wherein the heat sink comprises a bottom plate and a plurality of fins formed on the bottom plate, and the LED module is attached to a bottom surface of the bottom plate.

10. The LED lamp as claimed in claim 1, wherein a connecting portion extends downwardly from the base of the housing, adapted for securing the LED lamp to a support member.

11. An LED lamp, comprising:
a housing;
a heat sink located on a top end of the housing;
an LED module received in the housing and attached to a bottom surface of the heat sink;
a printed circuit board arranged on a bottom end of the housing; and
a reflector located on the printed circuit board, the reflector having a slantwise surface relative to the LED module, whereby light generated by the LED module can be omnidirectionally reflected out of the housing by the reflector.

12. The LED lamp as claimed in claim 11, wherein the reflector is conical, with a tip end thereof facing towards the LED module.

13. The LED lamp as claimed in claim 11, wherein the reflector is a polyhedron with a bottom end thereof facing towards the printed circuit board.

14. The LED lamp as claimed in claim 11, wherein a plurality of windows is defined in lateral sides of the housing, and an envelope is fitly received in the housing and extends over the windows.

15. The LED lamp as claimed in claim 14, wherein a waterproof cushion is sandwiched between the bottom end of the housing and the envelope, and a waterproof cushion is sandwiched between the envelope and the heat sink.

16. An LED lamp comprising:

a housing having a base, a top frame and a plurality of stanchions interconnecting the base and the top frame, a window being defined between two neighboring stanchions;

an envelope secured to the housing and covering the window;

a heat sink mounted on the top frame;

an LED module received in the housing and attached to a bottom surface of the heat sink;

a reflector received in the housing;

wherein light generated by the LED module is reflected by the reflector to run through the envelope to illuminate a surrounding environment of the LED lamp.

17. The LED lamp as claimed in claim 16, wherein the reflector has a cone-shaped configuration with a tip pointing toward the LED module.

18. The LED lamp as claimed in claim 17, wherein the cone-shaped reflector has legs extending downwardly to engage with the base of the housing.

19. The LED lamp as claimed in claim 18 further comprising a first waterproof cushion sandwiched between the bottom surface of the heat sink and a top of the envelope and a second waterproof cushion sandwiched between the base and the a bottom of the envelope.

20. The LED lamp as claimed in claim 19, wherein the housing has a connecting portion extending downwardly from the base, adapted for connecting with a supporting structure.

* * * * *